United States Patent [19]

Geisler

[11] Patent Number: 4,708,928

[45] Date of Patent: Nov. 24, 1987

[54] PHOTOTHERMOGRAPHIC ELEMENT COMPRISING PARTICLES EACH CONTAINING SILVER HALIDE, A SILVER COMPOUND AND REDUCING AGENT

[75] Inventor: Thomas C. Geisler, Cottage Grove, Minn.

[73] Assignee: Minnesota Mining and Manufacturing Company, St. Paul, Minn.

[21] Appl. No.: 902,208

[22] Filed: Aug. 29, 1986

[51] Int. Cl.[4] ..... G03C 1/06

[52] U.S. Cl. ..... 430/619; 430/203; 430/351; 430/353; 430/570; 252/188.31

[58] Field of Search ..... 430/617, 619, 203, 351, 430/353, 570

[56] References Cited

U.S. PATENT DOCUMENTS

| | | | |
|---|---|---|---|
| 3,982,938 | 9/1976 | Honjo et al. | 430/96 |
| 4,400,456 | 8/1983 | Matsuda et al. | 430/138 |
| 4,416,966 | 11/1983 | Sanders et al. | 430/138 |
| 4,430,415 | 2/1984 | Aono et al. | 430/283 |
| 4,440,846 | 4/1984 | Sanders et al. | 430/138 |
| 4,450,227 | 5/1984 | Holmes et al. | 430/339 |
| 4,460,681 | 7/1984 | Frenchik | 430/502 |
| 4,514,493 | 4/1985 | Hirai et al. | 430/617 |
| 4,594,307 | 6/1986 | Ishida | 430/203 |

*Primary Examiner*—J. David Welsh

*Attorney, Agent, or Firm*—Donald M. Sell; James A. Smith; Mark A. Litman

[57] ABSTRACT

Photothermographic imaging chemistry, and particularly color chemistry, can be contained within solid particles. Photothermographic media can then be made by dispersing these particles within a binder in the concentrations and proportions desired.

21 Claims, No Drawings

PHOTOTHERMOGRAPHIC ELEMENT COMPRISING PARTICLES EACH CONTAINING SILVER HALIDE, A SILVER COMPOUND AND REDUCING AGENT

BACKGROUND OF THE INVENTION

1. Field of the Invention

The present invention relates to photothermographic imaging systems comprising a true dispersion of photothermographically active particles in a binder. Single imaging layer, single sheet, color photothermographic elements may be formed by combinations of particles.

2. Background of the Art

Silver halide photothermographic imaging materials, often referred to as "dry silver" compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver ions which are in catalytic proximity to the specks of the latent image.

As the visible image is produced entirely by silver, one cannot readily decrease the amount of silver in the emulsion without reducing the available maximum image density. Reduction of the amount of silver is desirable in order to reduce the cost of raw materials used in the emulsion.

One traditional way of attempting to increase the image density of photographic and photothermographic emulsions without increasing or while decreasing the amount of silver in the emulsion layer is by the addition of dye forming materials into the emulsion.

U.S. Pat. No. 4,021,240 discloses the use of sulfonamidophenol reducing agents and four equivalent photographic color couplers in thermographic and photothermographic emulsions to produce dye images including multicolor images.

U.S. Pat. No. 4,022,617 discloses the use of leuco dyes (referred to as leuco base dyes) in photothermographic emulsions. These leuco dyes are oxidized to form a color image during the heat development of the photothermographic element. A number of useful toners and development modifiers are also disclosed.

Various color toning agents which modify the color of the silver image of photothermographic emulsions and darken it to a black or blue-black image are also well known in the art as represented by U.S. Pat. Nos. 4,123,282; 3,994,732; 3,846,136 and 4,021,249.

U.S. Pat. No. 3,985,565 discloses the use of phenolic type photographic color couplers in photothermographic emulsions to provide a color image.

U.S. Pat. No. 3,531,286 discloses the use of photographic phenolic or active methylene color couplers in photothermographic emulsions containing p-phenylenediamine developing agents to produce dye images.

Research Disclosure 17029, "Photothermographic Silver Halide Systems," published June 1978, pp. 9–15, gives a brief history of photothermographic systems and discusses attempts to provide color to them. Many of these previously discussed patents and other art such as U.S. Pat. Nos. 4,022,617; 3,180,731 and 3,761,270 are noted as relevant to the subject of providing dye density and color images to photothermographic emulsions.

H. G. McGuckin, Research Disclosure No. 13443, issued Jan. 1975, showed formation by the reaction of leuco base triphenylmethane dyes with silver behenate using development modifiers phthalazinone, phthalimide, and phthalic anhydride. A test for useful leuco dyes was also described.

R. S. Gabrielsen, R. G. Willis, and F. M. Cerquone, Research Disclosure No. 15126, issued Nov. 1976, showed color formation by the reaction of silver behenate with a reducing agent which comprises an azomethine dye or an azo dye in the presence of N-hydroxy-1,8-naphthalimide.

R. G. Willis, Research Disclosure No. 15676, issued April 1977, describes dye enhanced silver images by dye bleach in non-light exposed areas by developing agent which is oxidized by the silver in the light exposed areas. The dye remains unchanged in imaged areas. The use of indoaniline and indophenol dyes was cited as a reducing agent.

F. M. Cerquone, R. S. Gabrielsen and R. H. Willis, U.S. Pat. No. 4,021,240, issued May 3, 1977 show multiple layers in column 22, lines 7 to 65 and column 23, line 1 to 57. Interlayers of polyvinyl alcohol were used to preserve the integrity of the color-forming layers. Other hydrophilic polymers, such as gelatin, were also found useful. The use of other synthetic polymeric binders alone or in combination as vehicles or binding agent and in various layers was described. Useful resins such as poly(vinyl butyral), cellulose acetate butyrate, polymethyl methacrylate, ethyl cellulose, polystyrene, polyvinyl chloride, chlorinated rubber, butadiene-styrene copolymers, vinyl chloride-vinyl acetate copolymers;

copolymers of vinyl acetate, vinyl chloride, and maleic acid and poly(vinyl alcohol) were cited.

U.S. Pat. No. 4,460,681 discloses a color photothermographic element in which color forming layers are separated by barrier layers to prevent migration of components between layers which would reduce the color separation.

U.S. Pat. No. 4,594,307 discloses a thermal diffusion transfer photothermographic element in which individual color sheets are used to provide colors. Multiple color images are formed by the use of multiple sheets of different colors.

Research Disclosure 18755 issued Nov. 1979 discloses a color photothermographic emulsion in which color photothermographic chemistry is dissolved or carried in a liquid medium and the liquid medium dispersed (emulsified) in a binder. The true emulsion can have different color forming packets of chemistry therein.

SUMMARY OF THE INVENTION

Conventional photothermographic chemistry is placed in a polymeric binder and non-developmentally sensitized particles of the chemistry in the binder are produced. The particles are then dispersed in a solution of a second polymeric binder, coated, and dried to form a photothermographic imaging layer. By combining particles in the second binder (referred to as the "layer binder") that are differently spectrally sensitized and which have differing color forming couplers or color forming developers, single layer multicolor elements may be formed. The color images may be retained in the original element or transferred by diffusion or sublimation.

DETAILED DESCRIPTION OF THE INVENTION

A dispersion of particles containing color photothermographic chemistry therein is formed within a polymeric binder. The dispersion is not what is termed a dispersion in the photographic art, which is actually an emulsion of a liquid medium dispersed within a solid carrier phase. The dispersion of the present invention is a configuration wherein solid particles exist within a solid binder layer. The size of the useful particles is generally between 0.5 and 100 microns, and preferably between 1 and 20 microns. The construction may consist of one or more layers of black-and-white photothermographic particles in layers, or one or more layers of color photothermographic particles in layers, or one or more layers of both black-and-white and/or color photothermographic particles.

Typically, photothermographic chemistry is prepared in a single composition with binder, and particles are formed in any manner which does not developmentally sensitize the silver halide in the chemistry. For example, if silver halide is present in the chemistry, milling of the composition to form the particles would not be desirable because this tends to sensitize the silver halide because of the abrasion of the grains. If silver salts and latent halidizing agents are used, however, the particles can be formed by milling and the silver halide formed by delatentizing (activating) the halidizing agents. It has been found to be preferred to spray the composition so that dried particles are formed in conventional spray drying equipment used in polymer particle formation processes. The dry silver photothermographic chemistry may also be contained within particles formed during emulsion polymerization.

Conventional silver halide photothermographic chemistry is used as the photothermographic chemistry in the system of the present invention. Such chemistry is well described in U.S. Pat. Nos. 3,457,075; 3,839,049; 3,985,565; 4,022,617 and 4,460,681. These can be either black-and-white or color chemistries. Either in situ halidization (e.g., U.S. Pat. No. 3,457,075) or preformed silver halide sources (e.g., U.S. Pat. No. 3,839,049) may be used. Any of the various photothermographic media, such as full soaps, partial soaps, full salts, and the like may be used in the photothermographic chemistry contained in the particles.

Conventional photothermographic chemistry comprises a photosensitive silver halide catalyst, a silver compound capable of being reduced to form a metallic silver image (e.g., silver salts, both organic and inorganic, and silver complexes, usually light insensitive silver materials), a developing agent for silver ion (a mild reducing agent for silver ion), and a binder. Color photothermographic systems additionally have a leuco dye or dye forming developer (alone or in combination with a developer for silver ion), or a color photographic coupler which would require a color photographic developer to be used as the developing agent for silver ion. Thus both negative and positive systems can be used.

The leuco dyes and dye forming developers used in the present invention may be any colorless or lightly colored (i.e., Dmax of less than 0.2 in a concentration of 5% by weight in a 20 micron thick transparent binder layer) compound which forms a visible dye upon oxidation. The compound must be oxidizable to a colored state. Compounds which are both pH sensitive and oxidizable to a colored state are useful but not preferred, while compounds only sensitive to changes in pH are not included within the term "leuco dyes" since they are not oxidizable to a colored form.

The dyes formed from the leuco dyes in the various color-forming particles should of course be different. A difference of at least 60 nm in reflective or transmissive maximum absorbance is required. Preferably the absorbance maximum of dyes formed will differ at least 80 or 100 nm. When three dyes are to be formed, two should differ by at least these minimums, and the third should differ from at least one of the other dyes by at least 150 nm and preferably at least 200 or even at least 250 nm. This will provide a good, full color range for the final image.

Any leuco dye capable of being oxidized by silver ion to form a visible is useful in the present invention as previously noted. Dye forming developers such as those disclosed in U.S. Pat. Nos. 3,445,234; 4,021,250; 4,022,617 and 4,368,247 are useful. In particular, the dyes listed in Japanese Kohyo National Publication No. 500352/82, published Feb. 25, 1982 are preferred. Naphthols and arylmethyl-1-naphthols are generally preferred. Naphthols and preferred naphthols are described below.

Useful dye forming developers as disclosed in Japanese Kohyo No. 500352/82 include compounds of the formula:

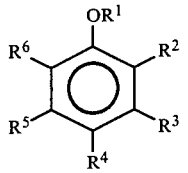

in which $R^1$ represents a hydrogen atom or hydrolysable group, each of $R^2$ to $R^6$ independently selected from a hydrogen or halogen atom, an alkyl, aryl, alkoxy, aryloxy or amino group each of which groups may be substituted, hydroxy group, a thiol group or a thioether group, or two or more adjacent groups from $R^2$ to $R^6$ may represent the necessary atoms to complete one or more carbocyclic or heterocyclic ring systems.

Naphthols suitable for use as dye-forming developing agents include alkoxy-1-naphthols, dialkylamino-1-naphthols and arylmethyl-1-naphthols.

Alkoxy-1-naphthols and masked naphthols include those of the general formula:

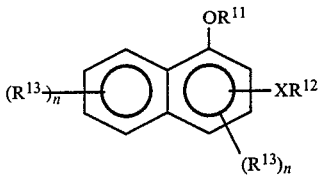

(2)

in which:

X is O, S or Se, $XR^{12}$ can be in the 2 or 4 position, $R^{11}$ is hydrogen or an alkali liable protecting group (i.e., a group which is converted to or replaced by hydrogen at a pH greater than 7.0), e.g. acetyl, chloroacetyl, dichloroacetyl, trichloroacetyl, trifluoroacetyl, carboalkyl, carboaryloxy, carbonate, benzoyl, n-nitrobenzoyl, 3,5-dinitrobenzoyl and 2-benzenesulphonyl-1-ethoxycarbonyl, $R^{12}$ represents a ballast group, e.g., alkyl, alkenyl, alkodxyalkyl, arylalkyl, aryloxyalkyl, alkylarylalkyl, alkylaryloxyalkyl, amino or dialkylaminoalkyl, trialkylammonium alkyl, acylamidoalkyl, carboxy and sulphocontaining alkyl, ester containing alkyl, these ballast groups are well known to those skilled in the art of silver halide photographic materials, and may contain up to 20 or 30 carbon atoms, each $R^{13}$ independently represents a ring substituent selected among the following groups: hydrogen, alkyl, aryl, hydroxy, alkoxy, aryloxy, amino, alkylamino, dialkylamino, arylamino, diarylamino, carboxy, carboalkoxy, carbonamido (all of which may contain up to 30 carbon atoms, preferably up to 12 carbon atoms), sulfonic acid, sulfonate, aryl-sulfonyl, sulfoalkoxy, sulfonamido, halide, e.g., fluorine, chlorine, bromide, iodine, and n is an integer between 0 and 4.

Dye forming developers of the amino naphthol type suitable for use in the invention include those of the general formula:

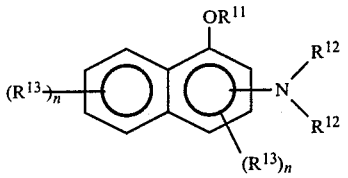

(3)

in which $R^{11}$, $R^{13}$ and n are as defined above in formula (2), the amino group can be either in the 2 or 4 position, and each $R^{12}$ is as defined above in formula (2) or together represent the necessary atoms to form a heterocyclic ring such as 2,5-dialkylpyryl, 2,6-dialkyl-1,4-oxazolyl and 4-oxo-pyridyl.

Dye-forming developers of the alkyl-1-naphthol type include those of the general formula:

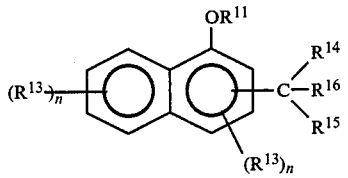

(4)

in which the $CR^{14}R^{15}R^{16}$ group can be in the 2 or 4 position, $R^{11}$, $R^{13}$ and n are as defined above, $R^{14}$ represents alkyl (of up to 20 carbon atoms) or preferably hydrogen, $R^{15}$ is hydrogen, alkyl (of up to 20 carbon atoms) or preferably an aromatic group, e.g., phenyl, p-hydroxyphenyl, p-tolyl, p-anisyl, xylyl, mesityl, p-dialkylaminophenyl, p-biphenyl, 1-naphthyl, 2-naphthyl, 9-anthracenyl and phenanthryl, $R^{16}$ is preferably an aromatic group capable of activating the methine hydrogen of the naphthol developer e.g., aryl, alkylaryl, alkoxyaryl, hydroxyaryl, tropyl, $R^{16}$ together with $R^{15}$ represents the necessary atoms to complete a carbocyclic or heterocyclic ring system which is fused or linked to one or more aromatic rings.

Polynuclear hydroquinones and their monoethers are also useful in the practice of the present invention, as are heterocyclic hydroquinones, naphthohydroquinones, bisphenols, 2-naphthols, amino naphthohydroquinone developer precursors (keto-1,3-naphthoxazoline), 4-alkoxy-1-naphthols, 4-arylmethyl-1-naphthols, dialkylamino-1-naphthols, polynuclear hydroquinones, p-bisphenols, o-bisphenols, bis-alpha-naphthols and the like are useful. U.S. Pat. No. 4,460,681 provides a good general list of known dye-forming developers useful in the present invention.

Conventional photothermographic chemistry is usually constructed as one or two layers on a substrate. Single layer constructions must contain the silver source material, the silver halide, the developer and binder as well as optional additional materials such as toners, coating aids and other adjuvants. Two-layer constructions must contain silver source and silver halide in one emulsion layer (usually the layer adjacent substrate) and the other ingredients in the second layer or both layers. In the present invention it is preferred to use single layer chemistry and form the particles therefrom. It is possible to use two-layer chemistry by forming particles and coating them with the second layer chemistry, by putting the second layer chemistry in the layer binder (rather than the particle binder), or by coating a traditional second layer over the particle containing layer of the present invention.

The silver source material, as mentioned above, ordinarily may be any material which contains a reducible source of silver ions. Silver salts of organic acids, particularly long chain (10 to 30, preferably 15 to 28 carbon atoms) fatty carboxylic acids are preferred in the practice of the present invention. Complexes of organic or inorganic silver salts wherein the ligand has a gross stability constant between 4.0 and 10.0 are also useful in the present invention. The silver source material should constitute from about 20 to 70 percent by weight of the imaging particles. Preferably it is present as 30 to 55 percent by weight.

The silver halide may be any photosensitive silver halide such as silver bromide, silver iodide, silver chloride, silver bromoiodide, silver chlorobromoiodide, silver chlorobromide, etc., and may be added to the particle in any fashion which places it in catalytic proximity to the silver source. The silver halide is generally present as 0.75 to 15 percent by weight of the particle, although larger amounts are useful. It is preferred to use from 1 to 10 percent by weight silver halide in the particle and most preferred to use from 1.5 to 7.0 percent.

Different groups of individual particles when used in color systems are individually sensitized to different portions of the electromagnetic spectrum and are associated with different color forming materials. For example, in subtractive systems, a particle sensitive to red light would form a cyan dye, a particle sensitive to green light would form a magenta dye, and a particle sensitive to blue light would form a yellow dye. In additive systems, a particle sensitive to blue light would form a blue dye, a particle sensitive to green light would form a green dye, and a particle sensitive to red light would form a red dye.

The silver halide may be provided by in situ halidization or by the use of pre-formed silver halide. The use of sensitizing dyes for the silver halide is particularly desirable. These dyes can be used to match the spectral response of the emulsions to the spectral emissions of intensifier screens. It is particularly useful to use J-banding dyes to sensitive the emulsion as disclosed in U.S. Pat. No. 4,476,220.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 20 percent by weight of the imaging particle. In a two-layer construction, if the reducing agent is in the second layer, slightly higher proportions, of from about 2 to 20 percent tend to be more desirable.

Toners such as phthalazinone, phthalazine and phthalic acid are not essential to the construction, but are highly desirable. These materials may be present, for example, in amounts of from 0.2 to 5 percent by weight.

The binder may be selected from any of the well-known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are, of course, included in these definitions. The polyvinyl acetals, such as polyvinyl butyral and polyvinyl formal, and vinyl copolymers, such as polyvinyl acetate/chloride are particularly desirable. The binders are generally used in a range of from 20 to 75 percent by weight of the particle, and preferably about 30 to 55 percent by weight.

In describing materials useful according to the present invention, the use of the term "group" to characterize a class, such as alkyl group, indicates that substitution of the species of that class is anticipated and included within that description. For example, alkyl group includes hydroxy, halogen, ether, nitro, aryl and carboxy substitution while alkyl or alkyl radical includes only unsubstituted alkyl.

As previously noted, various other adjuvants may be added to the photothermographic particle of the present invention. For example, toners, accelerators, acutance dyes, sensitizers, stabilizers, surfactants, lubricants, coating aids, antifoggants, leuco dyes, chelating agents, binder crosslinking agents, and various other well-known additives may be usefully incorporated in either the particle or continuous layer. The use of acutance dyes matched to the spectral emission of an intensifying screen is particularly desirable.

The binder and its solvent (if any) used to associate the various particles is preferably not able to dissolve the active photothermographic chemistry within the particle. If it were a very active solvent for the chemistry, it would tend to leach out the chemistry and alter the sensitometry for the system with time. This can be avoided by using different solvent systems in the binder and in the particles and/or using polymer systems in the respective portions which are not soluble in a common solvent. For example, poly(vinyl butyral) may be used for the particle binder and poly(vinyl alcohol) may be used for the layer binder. It is also possible to form the particles, apply a thin polymeric barrier layer over the particles to prevent migration of active photothermographic chemistry, and then add the coated particles to a binder composition. Poly(vinyl alcohol) provides a good particle coating composition for that type of construction.

There should be sufficient binder present with the particles that upon monochromatic exposure of one set of particles at the wavelength of maximum sensitivity for that particle and after thermal development of that particle to a Dmax of 0.5, no other color displays an optical density of 0.2 or more above fog. Preferably no other color displays an optical density of 0.15 above fog under these conditions, and most preferably no other color displays an optical density of more than 0.10 above fog.

A particularly useful chemistry which can be present in the layer binder is stabilization chemistry, and particularly image stabilization chemistry. These materials can be present in the layer binder and be driven into the particles by thermal development after exposure and development of the image. Crosslinking agents, either active or thermally latent, for the particle binder or the binder in the photosensitive layer can be present in the layer binder. Other standard addenda such as coating aids, antifoggants, accelerators, toners, and acutance dyes may be present in the particle binder or the layer binder.

There are a wide number of advantages to the practice of the present invention that have not been available to photothermographic systems of the prior art. Multicolor, single layer, photothermographic elements can be readily made. Even single layer multicolor transfer or color diffusion elements can be produced. A stable, color-forming photothermographic particle can be produced which can be blended into various systems. The stable particles can be stored and used in different systems and can be used to easily adjust the color balance of a system. In color transfer systems, a single sheet can be used rather than separate sheets for each color.

These and other aspects of the present invention will be shown in the following non-limiting examples.

METHODS USED IN THE EXAMPLES

The following steps are involved in preparing the single layer color dry silver construction and are done under appropriate safelight conditions:

1. Prepare the single color dry silver dispersions/solutions containing all necessary imaging chemistry and polymeric resin/binder.
2. Convert the dispersions/solutions to dry particles. In this work, spray drying was used to produce the particles.
3. Disperse each monocolor powder in a resin solution.
4. Blend the various color dispersions.
5. Coat on substrate and dry.

The dry silver solution formulations are listed in Table I–III. A typical solution preparation is as follows: the silver soap homogenate is diluted with solvent, mixed for 5–10 minutes, Butvar added, and mixed for 10–15 minutes. The mercuric bromide solution is added in two equal portions with a 15–20 minute wait between adds and a 2-hour digestion after the second add. The Butvar resin is added and the solution stirred for 2 hours. This solution can be used immediately or stored for several weeks. The final solution preparation is completed just prior to spray drying. If necessary, the halidized silver soap/resin solution is diluted with solvent and mercuric acebate solution added. The sensitizing dye solution is added followed by a one-hour wait. Finally, the developer dye, toner, and additional solvent are added, mixed for 15 minutes and filtered through several layers of cheesecloth.

Spray drying was accomplished using a Buchi Model 90 spray dryer. Typical operating conditions were: atomizer flow setting 200, pump setting 7, aspirator control setting 20, heat on, a heater setting of 0, an inlet temperature of 43° C., an outlet temperature of 30° C., and a filter backpressure of 60 mbar.

Two methods were used to disperse the spray dried powder in an aqueous polyvinyl alcohol resin solution. The first method consisted of dispersal in water-surfactant or water-surfactant-polyvinyl alcohol using an ultrasonic bath. In the second method, the powder, water, surfactant, and a portion of the polyvinyl alcohol were added to a jar half full of 6 mm glass beads and placed on a shaker for one hour. The remaining polyvinyl alcohol solution was added and shaken for an additional 30 minutes. The dispersion was then allowed to stand overnight to allow the foam to dissipate.

EXAMPLE 1

Blue sensitive, yellow image construction

Solution 1 was spray dried yielding 8.2 g of powder having a particle size range of one to 15 microns. A dispersion was prepared consisting of 2.0 g spray dried powder, 1.0 g 10% alconox solution, 16.6 g water, and 83.4 g 12% aqueous solution of Gelvatol 20-60 polyvinyl alcohol using the ultrasonic bath. This dispersion was coated at 3.0 mil on 3 mil opaque polyester and dried for 3 minutes at 180° F. This sample was exposed to blue light (460 nm) and heat processed for 20 seconds at 260° F. yielding a yellow image. Dmin was 0.12 and Dmax was 0.43 (Macbeth densitometer, blue filter).

EXAMPLE 2

Green sensitive, magenta image construction

Solution 2 was spray dried yielding 5.8 g of powder having a particle size range of 2 to 10 microns. A dispersion was prepared consisting of 2.0 g spray dried powder, 1.5 g 10% alconox solution, 16.6 g water, and 83.4 g 12% aqueous Gelvatol 20-60 using the ultrasonic bath. This dispersion was coated and dried as Example 1. Exposure to green light (520 nm) and heat processing for 20 seconds at 60° F. resulted in a magenta image with Dmin of 0.13 and Dmax of 0.37 (Macbeth densitometer, green filter).

EXAMPLE 3

Blue-green sensitive, yellow-magenta image construction 50 g of yellow color-forming dispersion from Example 1 and 50 g of magenta color-forming dispersion from Example 2 were mixed, coated at 5.0 mil on 3 mil opaque polyester and dried for 5 minutes at 180° F. Exposure to blue light (460 nm) and heat processing for 20 seconds at 260° F. resulted in a yellow image with Dmin of 0.22 and Dmax of 0.49 (Macbeth densitometer, blue filter). Exposure to green light (520 nm) and heat processing for 20 seconds at 260° F. resulted in a magenta image with a Dmin of 0.10 and Dmax of 0.33 (Macbeth densitometer, green filter).

EXAMPLE 4

Red sensitive, cyan image construction

Solution 5 was spray dried yielding 3.33 g of powder with a particle size range of one to 20 microns. A dispersion consisting of 1.0 g powder, 15.2 g water, 0.50 g Nopcosant L, and 33.3 g 12% Gelvatol 20-60 solution was prepared by shaking with glass beads. The dispersion was coated at 4 mil wet on 3 mil opaque polyester and dried for 5 minutes at 180° F. When this sample was exposed to red light (640 nm) and heat processed for 10 seconds at 260° F., a cyan image was produced with Dmin of 0.17 and Dmax of 0.96 (red filter).

EXAMPLE 5

Panchromatic, full color construction

Solution 3 was spray dried yielding 20.4 g of blue-sensitive yellow color-forming powder with a particle size range of one to 20 microns. Solution 4 was spray dried yielding 22.6 g of green-sensitive magenta color-forming powder with a particle size range of one to 20 microns. Separate dispersions using these two powders and the powder from Example 4 were prepared using the glass bead/shaker method. The composition of each dispersion was:

| | |
|---|---|
| Spray dried powder | 1.5 g |
| Water | 15.2 g |
| Nopcosant L surfactant | 0.5 g |
| 12% Gelvatol 20–60 solution | 33.3 g |

Twenty grams of each dispersion were combined, mixed, coated at a thickness of 5 mil on 3 mil opaque polyester, and dried for 5 minutes at 180° F. When exposed to blue, green, and red light and processed for 10 seconds at 260° F., the complimentary yellow, magenta, and cyan images were formed. The imaged sheet has the following properties:

| Exposure Wavelength (nm) | Image Color | Dmin | Dmax | Densitomer Filter Color |
|---|---|---|---|---|
| 460 (blue) | Yellow | 0.11 | 0.42 | Blue |
| 520 (green) | Magenta | 0.09 | 0.44 | Green |
| 640 (red) | Cyan | 0.19 | 0.75 | Red |

When contact exposed to color negative and processed for 10 seconds at 250° F., a full color print resulted with very good color separation.

EXAMPLE 6

Panchromatic, full color thermal-diffusion transfer construction

The 3 mil opaque polyester base was coated at 3 mil wet with a 15% solution of VYHH resin in 2-butanone and dried for 3 minutes at 180° F. Thirty grams of each monocolor dispersion (C, M and Y) from Example 5 were diluted with 15 g of water and mixed. Fifteen grams of each diluted dispersion were combined, mixed, coated at 5 mil wet on the VYHH layer, and dried for 5 minutes at 180° F. A sample of this construction was exposed to red light (640 nm) and processed for 30 seconds at 270° F. yielding a cyan image on a green background. The dry silver/polyvinyl alcohol layer was stripped off revealing a weak cyan image on a white background in the VYHH layer. Similarly, a sample was exposed to green light (520 nm), processed for 30 seconds at 270° F., providing a magenta image on a green background. Stripping the dry silver layer revealed a weak magenta image on a white background in the VYHH layer. Exposure to blue light (460 nm) and processing for 30 seconds at 270° F. also produced a magenta image in both the dry silver and VYHH layers. However, reducing the processing conditions to 10 seconds at 270° F. resulted in a yellow image contaminated with magenta in the Dmax region. Stripping the dry silver layer revealed a faint yellow image on a white background in the VYHH layer. Although the image densities in this construction are low and the three color-forming reactions are not balanced, it does demonstrate the feasibility of using the one layer concept in a thermal diffusion transfer construction.

Attempts were made to duplicate the one- and two-layer multicolor photothermographic imaging systems disclosed in Research Disclosure 18755, November 1979, pp. 651–652. Halidized silver soap dispersions were prepared and the liquid was emulsified in a binder solution and droplets trapped within the solidified binder (polyvinyl alcohol). In single color sheets, good color images were produced. When multiple colors were used in a single layer, the different color tended to associate during the emulsification step and there was little color separation. In fact, in almost all case, no color separation was seen. This shows that the use of particles in the present invention rather than droplets as taught in the prior art provides a significant improvement in the photothermographic product.

TABLE I

| Component | Solution 1 | Solution 2 |
|---|---|---|
| Silver half-soap homogenate | 63.5 g | 63.5 g |
| 10% in 90 toluene/10 acetone) | 43.75 g | 43.75 g |

TABLE I-continued

| Component | Solution 1 | Solution 2 |
|---|---|---|
| 2-Butanone | | |
| Butvar B-76 | 0.05 g | 0.05 g |
| Mercuric Bromide solution (3.6 g/100 ml methanol) | 6.0 ml | 6.0 ml |
| Butvar B-76 | 7.0 g | 7.0 g |
| MSD-454 Blue Sensitizing dye solution (18 mg/100 ml methanol) | 4.65 ml | — |
| MSD-534 Green Sensitizing dye solution (20 mg/100 ml methanol) | — | 6.2 ml |
| AM-25 yellow developer solution (10 g/90 g acetone) | 3.72 g | — |
| Syringaldazine magenta developer | — | 0.75 g |
| Phthalazinone | 0.93 g | 2.20 g |
| Methylene chloride | 224.0 g | 224.0 g |

AM-25 6,6' di-t-butyl-4,4'-bi-o-cresol

MSD-454

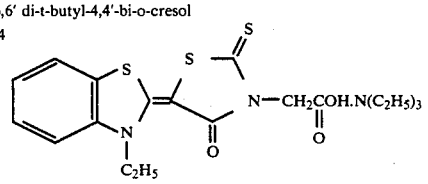

MSD-534

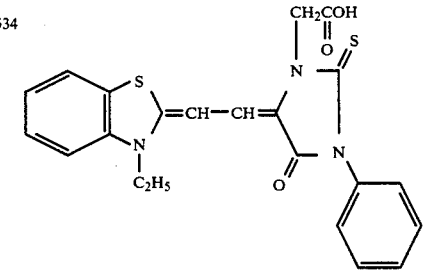

TABLE II

| Component | Solution I | Solution 2 |
|---|---|---|
| Silver half-soap homogenate (13.3% in acetone) | 47.7 g | 47.7 g |
| Acetone | 64.0 g | 64.0 g |
| Butvar B-76 Resin | 0.05 g | 0.05 g |
| Mercuric Bromide solution (3.6 g/100 ml methanol) | 6.0 ml | 6.0 ml |
| Butvar B-76 Resin | 21.0 g | 21.0 g |
| Acetone | 209.0 g | 138.0 g |
| Mercuric Acetate solution (0.2 g/10 g methanol) | — | 10.2 g |
| MSD-454 Blue Sensitizing dye solution (18 mg/100 ml methanol) | 2.3 ml | — |
| MSD-96 Green Sensitizing dye solution (4 mg/20 g methanol) | — | 20.0 g |
| AM-25 yellow developer | 0.372 g | — |
| Syringaldazine magenta developer | — | 0.75 g |
| Tetrahydrofuran | 20.0 g | — |
| Phthalazinone | 0.93 g | 2.25 g |
| Acetone | 357.0 g | 450.0 g |

MSD 96

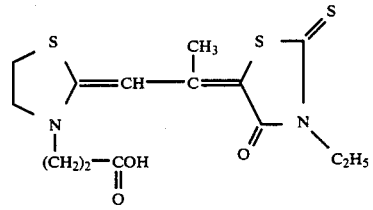

TABLE III

| Component | Solution 5 |
|---|---|
| Silver half-soap homogenate (10% in 90 ethanol/10 toluene) | 27.3 g |
| Ethanol | 95.0 g |
| Mercuric Bromide solution (5.7 g/100 ml methanol) | 0.67 ml |
| Butvar B-72A resin | 9.04 g |

TABLE III-continued

| Component | Solution 5 |
|---|---|
| MSD-563 Red Sensitizing dye solution (60 mg/100 ml methanol) | 0.82 ml |
| 3,6-diethylamino-9-(4-hydroxy-3,5-di-t-butylbenzoyl) phenoxazine cyan developer | 1.06 g |
| Phthalazinone | 0.80 g |
| Methanol | 321.0 g |

MSD-563

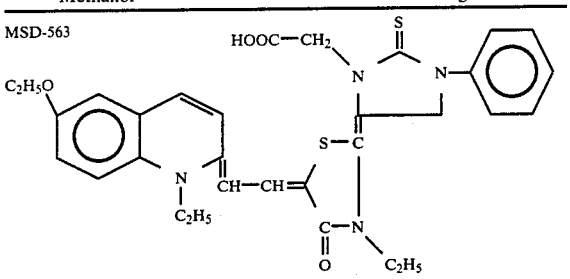

What is claimed is:

1. A photothermographic active particle having dimensions between 0.5 and 100 microns comprising a transparent binder, photosensitive silver halide, light insensitive silver compound, and a reducing agent for silver ion.

2. The particle of claim 1 wherein said reducing agent comprises an organic compound which forms a visibly colored dye upon oxidation.

3. The particle of claim 2 wherein said reducing agent is colorless before oxidation.

4. The particle of claim 3 wherein said light insensitive silver compound comprises an organic silver salt.

5. The particle of claim 4 wherein said organic silver salt comprises a silver salt of an organic fatty acid.

6. A photothermographic layer comprising particles as recited in claim 1 dispersed in a second binder different from the binder of said particles.

7. A photothermographic layer comprising particles as recited in claim 3 dispersed in a second binder different from the binder of said particles.

8. A photothermographic layer comprising particles as recited in claim 5 dispersed in a second binder different from the binder of said particles.

9. The layer of claim 6 wherein said second binder does not readily solubilize any of the photothermographic active chemistry within said particles.

10. The layer of claim 7 wherein said second binder does not readily solubilize any of the photothermographic active chemistry within said particles.

11. The layer of claim 8 wherein said second binder does not readily solubilize any of the photothermographic active chemistry within said particles.

12. The layer of claim 6 containing at least two different types of particles, each type of particle being spectrally sensitized to a portion of the electromagnetic spectrum different from that to which another type of particle is spectrally sensitized, and each type of particle being capable of generating a color upon exposure and thermal development which is different from the color generable by another type of particle within said layer.

13. The layer of claim 7 containing at least two different types of particles, each type of particle being spectrally sensitized to a portion of the electromagnetic spectrum different from that to which another type of particle is spectrally sensitized, and each type of particle being capable of generating a color upon exposure and thermal development which is different from the color generable by another type of particle within said layer.

14. The layer of claim 8 containing at least two different types of particles, each type of particle being spectrally sensitized to a portion of the electromagnetic spectrum different from that to which another type of particle is spectrally sensitized, and each type of particle being capable of generating a color upon exposure and thermal development which is different from the color generable by another type of particle within said layer.

15. The layer of claim 9 containing at least two different types of particles, each type of particle being spectrally sensitized to a portion of the electromagnetic spectrum different from that to which another type of particle is spectrally sensitized, and each type of particle being capable of generating a color upon exposure and thermal development which is different from the color generable by another type of particle within said layer.

16. The layer of claim 10 containing at least two different types of particles, each type of particle being spectrally sensitized to a portion of the electromagnetic spectrum different from that to which another type of particle is spectrally sensitized, and each type of particle being capable of generating a color upon exposure and thermal development which is different from the color generable by another type of particle within said layer.

17. The layer of claim 11 containing at least two different types of particles, each type of particle being spectrally sensitized to a portion of the electromagnetic spectrum different from that to which another type of particle is spectrally sensitized, and each type of particle being capable of generating a color upon exposure and thermal development which is different from the color generable by another type of particle within said layer.

18. A photothermographic element comprising the layer of claim 6 on a substrate.

19. A photothermographic element comprising the layer of claim 9 on a substrate.

20. A photothermographic element comprising the layer of claim 12 on a substrate.

21. A photothermographic element comprising the layer of claim 17 on a substrate.

* * * * *